United States Patent [19]

Whetstone, Jr. et al.

[11] 4,055,065

[45] Oct. 25, 1977

[54] METHOD AND APPARATUS FOR SIMULTANEOUS EDGE BENDING OF STAIR RAIL CAP STOCK AND CHANNEL STOCK

[75] Inventors: Cecil Whetstone, Jr.; Anthony G. Burns, both of Winona, Minn.

[73] Assignee: Hossfeld Manufacturing Co., Winona, Minn.

[21] Appl. No.: 743,645

[22] Filed: Nov. 22, 1976

[51] Int. Cl.[2] ..... B21D 7/03

[52] U.S. Cl. ..... 72/217; 72/217

[58] Field of Search ..... 72/217, 216, 150, 322, 72/388, 459, 159, 700, DIG. 18

[56] References Cited

U.S. PATENT DOCUMENTS

| | | | |
|---|---|---|---|
| 1,061,067 | 5/1913 | Grady | 72/159 |
| 2,399,892 | 5/1946 | Sato | 72/150 |
| 3,763,685 | 10/1973 | Fjellstrom | 72/217 |

*Primary Examiner*—Milton S. Mehr

*Attorney, Agent, or Firm*—Merchant, Gould, Smith, Edell, Welter & Schmidt

[57] ABSTRACT

A method and apparatus is disclosed for simultaneously bending a length of handrail channel stock and handrail cap stock in an iron bender with a main frame and a swing frame, which comprises the steps of fitting the channel stock, with a length of flat stock inserted between its flanges, into the recessed underside of the cap stock, and bending the resultant assembly in a bender fitted with appropriately grooved back block, forming die and drawing block.

6 Claims, 10 Drawing Figures

METHOD AND APPARATUS FOR SIMULTANEOUS EDGE BENDING OF STAIR RAIL CAP STOCK AND CHANNEL STOCK

BACKGROUND OF THE INVENTION

1. Field of the Invention

This invention relates to the field of edge bending metal stock. More particularly, this invention relates to the field of dies used in bending machines, and a method of simultaneously bending a piece of handrail cap stock and a piece of handrail channel stock.

2. Description of the Prior Art

In the installation of stair railings, several components are utilized: a length of channel stock is located 3 or 4 inches above the floor, a length of molded handrail cap stock is located approximately 3 feet above the floor, and plurality of spokes are mounted vertically between the handrail and the bottom channel approximately 4 or 5 inches apart from each other. Both the handrail and the bottom channel are parallel with the floor or stairway incline, and must be bent in a return bend to follow a winding stairway down or up.

Formerly, the lengths of cap stock and channel stock had to be bent in separate operations in a bending machine utilizing a radius block and in which the stock had to be continuously fed through the apparatus to achieve the desired curvature. The problems experience with "feed through" type production bending are that the bending process is slow, and that, since the amount of feed is regulated by the operator, the degree and trueness of the arc of curvature varies from piece to piece and operator to operator. These problems are magnified in the situation where two pieces, the channel piece and the handrail cap piece, must be mated in the final stair railing.

Methods and apparatus for "single pull" edge bending of flat stock without distortion or structural damage to the stock have been developed. Such systems utilize a stationary die to block movement of one end of the stock, called a back block, a die with a circular arc of predetermined radius around which the stock is to be bent, called a forming die, and a die to engage the stock along its unblocked portion and bend it around the forming die, called a drawing block. The drawing block is generally supported in an assembly which swings around the forming die by a roller block which rolls along the back surface of the drawing block. Once the stock has been placed between the forming die and drawing block, with one end blocked by the back block, the drawing block can be swung around the forming die in a single pull to achieve a bend of anywhere between 0° and approximately 180°. Such apparatus can be adapted to bend single pieces of stock having a fairly uniform cross section across their width, such as flat stock, or handrail cap stock, with no distortion. But twisting or distortion cannot be avoided if a piece of stock not having a generally uniform cross section across its width, such as the channel stock with its web and two flanges, is bent in such a bending operation. Thus, in order to shape the pieces of stock used to assemble a stair railing utilizing the previously known methods, the handrail cap stock can be bent in a single pull operation, but the bottom channel has to be bent in a separate operation. The problem of non-matching mate pieces remained unsolved until the present invention.

SUMMARY OF THE INVENTION

The present invention solves the problems inherent in the prior art by providing a special set of dies and a unique method for simultaneously bending two pieces of mated stock to the desired curvature in a single pull operation.

The dies are designed to bend both pieces together by grooving the portions of the dies that will come in contact with the working pieces to conform with the general outline of those working pieces. The handrail cap stock is molded and has a recess in its underside which is equal in width to the width of the channel stock; by placing a length of cap stock on top of a length of channel stock, which is fitted into the recessed underside of the cap, a convenient unit capable of being simultaneously bent is formed. The grooves in the die faces have a cross section substantially conforming to the right or left half of the cross section of the cap/channel unit.

The dies are mounted in the bender so that the grooved face of the forming die faces toward the grooves in the back and drawing blocks; the opposed grooves then form a recess which substantially conforms in cross section to the cross section of the cap/-channel unit. Before the cap/channel unit, a length of flat stock equal in width to the distance between the flanges of the channel stock is placed between those flanges to act as a spacer and to prevent them from deforming while the cap/channel unit is being edge bent. The cap/channel unit with insert in place is then bent to the desired curvature in the bender, after which the insert may be discarded.

Thus, the invention saves time and money by allowing two pieces to be bent in one operation with only one set of dies, resulting in two identically curved pieces that can be matched with each other in the assembly of a stair railing.

DESCRIPTION OF THE PREFERRED EMBODIMENT

Figure 1:
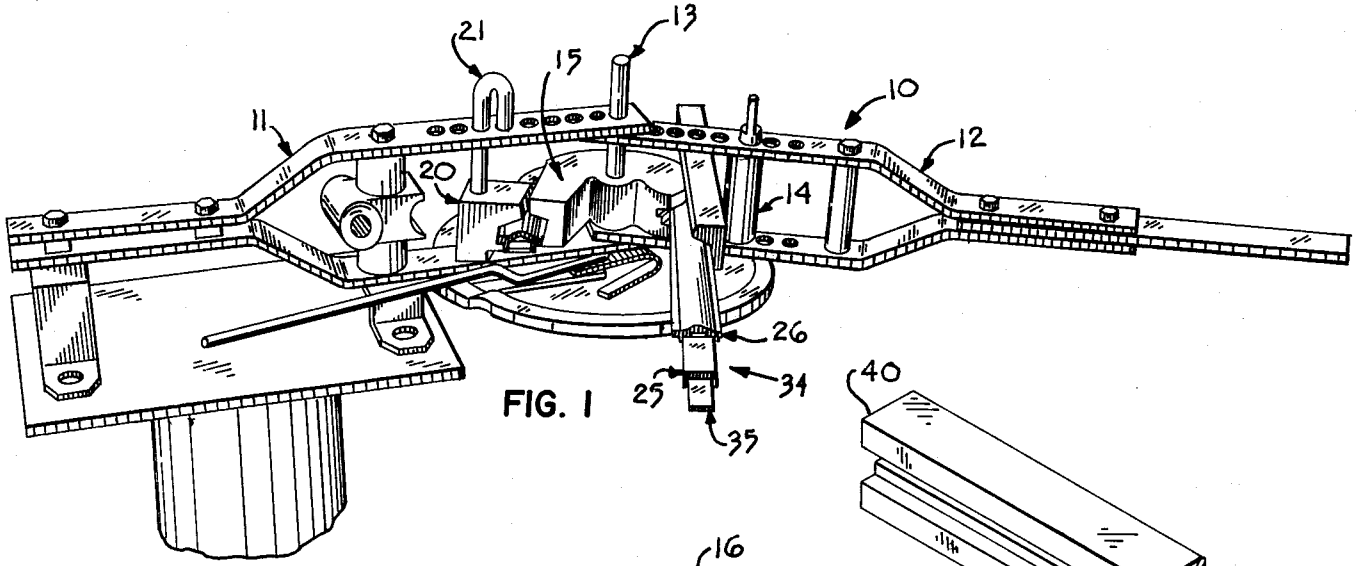
FIG. 1 is a view in perspective of an edge bending machine showing the dies of the present invention and a length of handrail/channel/flat stock mounted therein.
Figure 6:
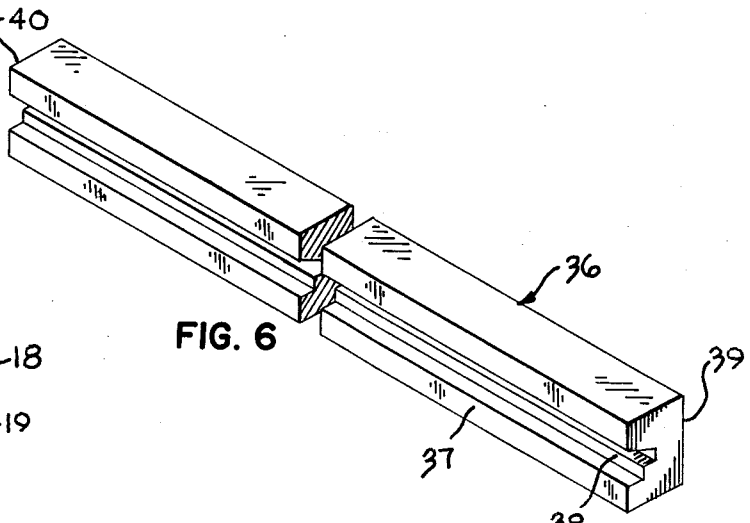
FIG. 6 is a view in perspective of the drawing block of the present invention.

FIG. 1 discloses an iron bender 10 having a stationary main frame 11 and a swing frame 12 hingedly connected thereto by center pin 13. A flat surface roller block 14 is releasably mounted in swing frame 12 at a predetermined radial distance from center pin 13.

Figure 5:
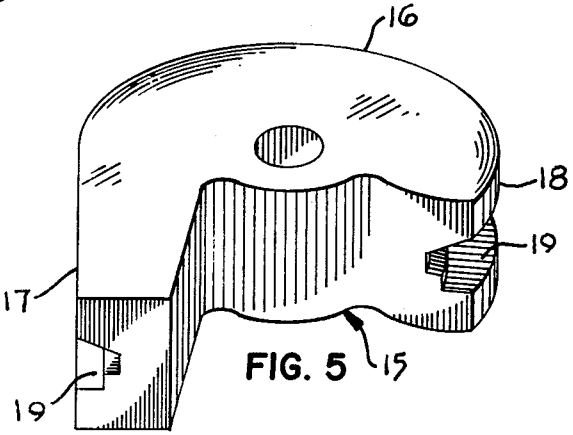
FIG.5 is a view in perspective of the forming die of the present invention.
Figure 7:
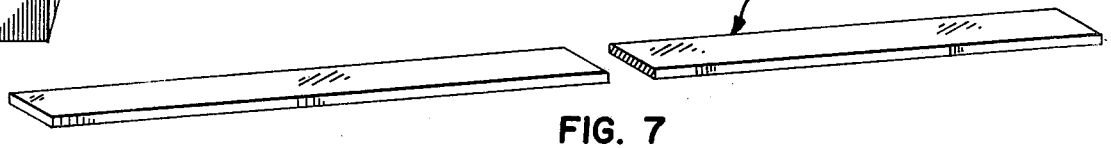
FIG. 7 is a view in perspective of the flat stock spacer of the present invention.
Figure 3:
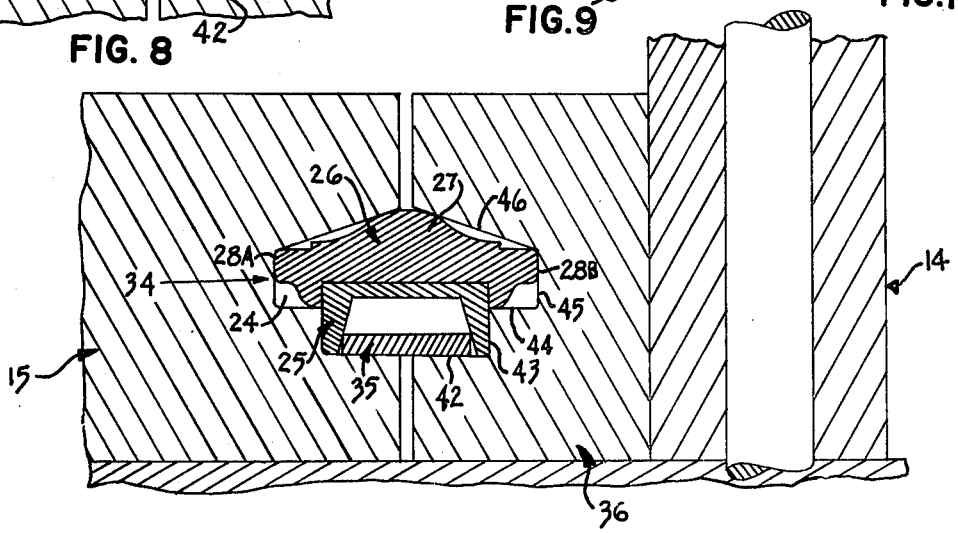
FIG. 3 is an end elevation taken generally along the line 3—3 of FIG. 2.

A forming die 15 is mounted on center pin 13. The forming die 15, which is more fully disclosed in FIG. 5, includes a generally semi-circular portion 16, a horn portion 17 extending generally tangentially from semi-circular portion 16, and a first side portion 18 extending along the periphery of semi-circular portion 16 and horn portion 17. Side portion 18 has a first groove 19 therein of uniform cross section over its length. As seen in FIG. 3, first groove 19 comprises a floor portion 42 extending inwardly from side portion 18, a channel flange engaging wall 43 extending upwardly from floor portion 42, a step portion 44 extending further inwardly from flange engaging wall 43, a cap edge engaging wall 45 extending further upwardly from step portion 44, and a ceiling portion 46 extending outwardly from cap edge engaging wall 45 at an oblique angle to intersect side portion 18.

Back block 20 is fixedly mounted in main frame 11 by means of pin 21 at a predetermined radial distance from center pin 13 so that back block 20 is adjacent horn portion 17.

Figure 4:
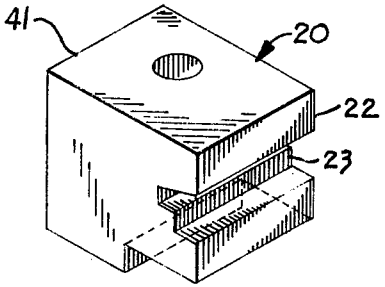
FIG. 4 is a view in perspective of the back block of the present invention.

Referring now to FIG. 4, back block 20 is generally rectangular in shape, being in dimension along its front-to-back axis generally equal in length to the length of horn portion 17. Back block 20 has a second side portion 22, which faces first side portion 18, having a second groove 23 therein of uniform cross section over its length, and a rear end portion 41.

Figure 8:
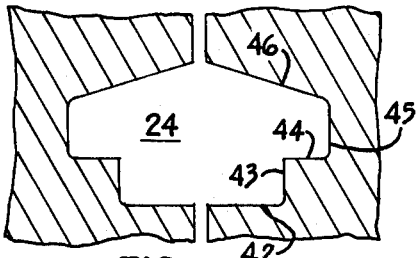
FIG. 8 is an end elevation of a portion of FIG. 3, showing the recess formed by the opposed grooves of the die pieces of the present invention.
Figure 9:
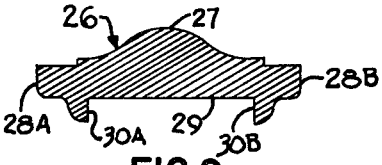
FIG. 9 is an end elevation of a piece of handrail cap stock.
Figure 10:
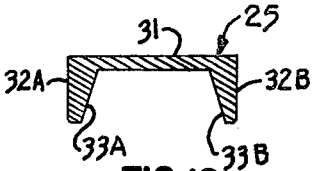
FIG. 10 is an end elevation of a piece of channel stock.

Second groove 23 is symmetric with first groove 19, being a mirror image thereof. When the back block 20 and forming die 15 are mounted in bender 10, opposed grooves 19 and 23 complement each other, as shown in FIG. 8, defining a recess 24 that substantially conforms to the cross section of a length of channel stock 25 with a length of cap stock 26 fitted atop thereof.

Drawing block 36 is elongated and generally rectangular in shape, being in dimension along its front-to-back axis generally equal in length to the length of first side portion 18, and includes a third side portion 37 with a third groove 38 therein, an opposite side wall 39, and a leading end portion 40. Third groove 38 is symmetric with first groove 19, being a mirror image thereof.

Referring to FIGS. 1 and 3, handrail cap stock 26 is a molded piece of metal stock having a dome portion 27 opposite cap edge portions 28*a* and 28*b,* and a recessed underside portion 29 with internal opposed side walls 30*a* and 30*b.*

Channel stock 25 comprises web portion 31 and external opposed walls 32*a* and 32*b,* defined by flange portions 33*a* and 33*b.*

Side walls 30*a* and 30*b* of underside portion 29 are a distance apart essentially equal to the distance between side walls 32*a* and 32*b* of channel stock 25.

A convenient cap stock/channel stock/flat stock assembly 34 is formed by fitting a length of flat stock 35 of width essentially equal to the distance between flanges 33*a* and 33*b* within the recess of a corresponding length of channel stock 25. Flat stock 35 acts as a spacer to prevent deformation of channel stock 25 during the bending operation. The length of channel stock 25 is then fitted into recessed underside portion 29 of a corresponding length of cap stock 26, so that side walls 30*a* and 30*b* engage side walls 32*a* and 32*b,* and the longitudinal axis of the length of cap stock 26 overlies the longitudinal axis of a length of channel stock 25, as seen in FIGS. 1 and 2.

Figure 2:
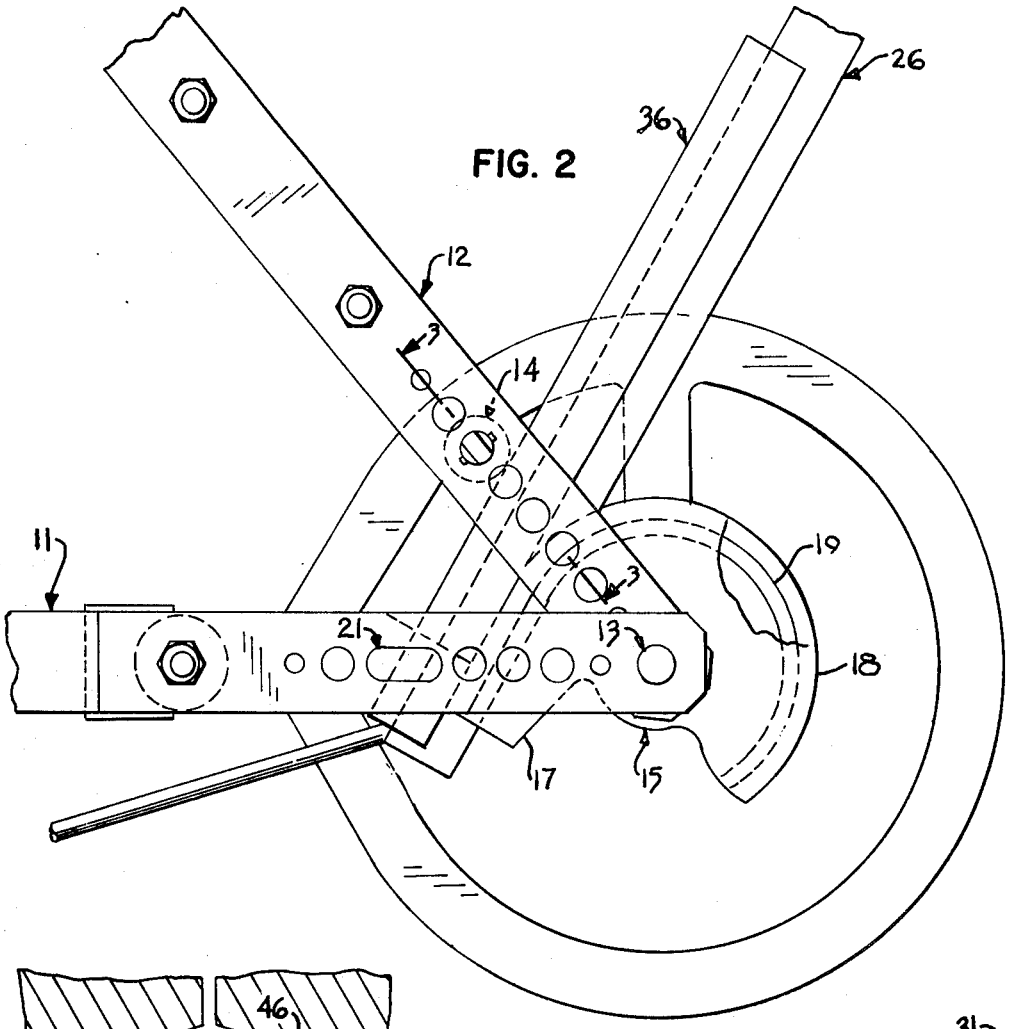
FIG. 2 is a top plan view of the edge bending machine of FIG. 1 with portions thereof broken away, showing the swing frame in the fully open position.

In operation, swing frame 12 is moved to its fully open position, as shown in FIG. 2, and one end of assembly 34 is inserted between back block 20 and forming die 15, extending through recess 24. With swing frame 12 in the fully open position, and assembly 34 extending through recess 24, drawing block 36 is positioned in swing frame 12 between roller block 14 and first side portion 18, with leading end portion 40 abutting rear end portion 41 of back block 20. In this position, groove 38 engages a portion of the length of assembly 34, and opposite side wall 39 abuts roller block 14. This configuration is clearly shown in FIG. 2.

The length of assembly 34 can then be bent to the desired degree of curvature — up to 180° — by moving swing frame 12 toward the fully closed position, illustrated in FIG. 1.

Once the desired bend has been achieved, roller block 14 and drawing block 36 are removed from swing frame 12 and assembly 34 is withdrawn from recess 24. The lengths of channel stock 25, cap stock 26, and flat stock 35 are then separated from each other and flat stock 35 discarded.

The results of the above-described operations are that correspondingly curved and undistorted lengths of channel stock 25 and cap stock 26 have been easily and inexpensively bent in a single pull operation.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. An edge bending die system for simultaneously bending a length of channel stock and a length of handrail cap stock in an iron bender which includes a main frame hingedly connected by a center pin to a swing frame with a flat surface roller block releasably mounted therein, comprising:

a. a forming die mounted on the center pin, which includes a generally semi-circular portion, a horn portion extending generally tangentially from said semi-circular portion, and a first side portion extending along the periphery of said semi-circular and horn portions, said first side portion having a first groove therein extending the length of said first side portion, said first groove being of uniform cross section over its length formed to accept the edge of a portion of a length of channel stock with a length of cap stock fitted atop thereof;

b. a back black having a second side portion with a second groove of uniform cross section over its length therein, complementing said first groove, fixedly mounted in the main frame adjacent said horn portion of said forming die, said second side portion facing toward said first side portion, the opposed grooves defining a recess that substantially conforms to the cross section of a length of channel stock with a length of cap stock fitted atop thereof; and c. a drawing block supported in position in the swing frame by the flat surface roller block, said drawing block including a third side portion complementing said first side portion, with a third groove of uniform cross section over its length therein, facing said first side portion, the opposed grooves together defining a recess that substantially conforms to the cross section of a length of channel stock with a length of cap stock fitted atop thereof, the drawing block further including an opposite side wall abutting the surface of the flat surface roller block.

2. The die system of claim 1 wherein said first groove comprises a floor portion extending inward from said portion, a channel flange engaging wall extending upward from said floor portion, a step portion extending further inward from said flange engaging wall, a cap edge engaging wall extending upward from said step portion, and a ceiling portion extending outwardly from said cap edge engaging wall at an oblique angle to intersect said side portion, and wherein said grooves in said second and third side portions are symmetric with said groove in said first side portion.

3. The die system of claim 2 wherein said drawing block has a length generally equal to the length of said first side portion and wherein said back block has a length generally equal to the length of said horn portion.

4. The method of insuring that the curvature in a length of edge bent channel stock conforms with the curvature in a length of edge bent handrail cap stock which is to be mated therewith in a stair railing system which comprises the steps of:

a. placing the two lengths of stock together so that the central longitudinal axis of one piece of stock overlies the central longitudinal axis of the second piece;

b. inserting a corresponding length of flat stock between the flanges of the length of channel stock, the width of said flat stock being generally equal to the distance between said flanges;

c. placing the lengths of stock so disposed in a swing frame iron bender with appropriate bending dies to accept the pieces; and d. moving the swing arm of the bender to simultaneously produce the desired curvature in the pieces of stock.

5. The method of simultaneously bending a length of channel stock having a web portion and opposite side walls defined by two flange portions, and a length of handrail cap stock having a dome portion, opposite cap edge portions, and a recessed underside portion with two side walls a distance apart corresponding to the distance between the side walls of the channel stock, in a conventional iron bender which includes a main frame hingedly connected by a center pin to a swing frame with a flat surface roller block releasably mountable therein at predetermined distances from the center pin, said swing frame having an open and a closed position with respect to the main frame, comprising the steps of:

a. inserting a strip of flat stock between the flanges of a length of channel stock to be bent, the width of said strip being generally equal to the distance between said flanges, and the length of said strip being generally equal to that of said length of channel stock;

b. fitting the length of channel stock with flat stock inserted into the recess in the underside of a corresponding length of handrail cap stock to be bent so that the side walls of the channel stock engage the side walls of the recess, forming a cap stock/channel stock/flat stock assembly with opposite edges;

c. mounting a forming die having a horn portion, a semi-circular portion, and a first side portion grooved to receive one edge of said cap stock/channel stock/flat stock assembly, on the center pin of the iron bender;

d. fixedly mounting a back block having a rear end portion and a second side portion grooved to cooperate with said first side portion in the main frame of the iron bender adjacent said horn position, with said second side portion facing said first side portion, said facing side portions defining a recess that substantially conforms to the cross section of a length of said assembly;

e. mounting a flat surface roller block in the swing frame of the iron bender at a predetermined distance from the center pin, moving the swing frame to the fully open position, and placing the portion of said assembly to be bent in the bender, said portion extending through said recess formed by said facing side portions, so that a portion of said first side portion engages a portion of said assembly and said second side portion engages a portion of said assembly;

f. mounting a drawing block having a third side portion grooved to receive an edge of said assembly, an opposite side wall, and a leading end portion, in the swing frame, with said leading end portion adjacent said rear end portion of said back block, a portion of said third side portion engaging a portion of an edge of said assembly, said opposite side wall abutting the flat surface roller block; and g. moving the swing frame from the fully open position toward the fully closed position until the desired degree of bend in said assembly has been achieved.

6. The method of insuring that the curvature in a length of channel stock conforms with the curvature in a length of handrail cap stock which is to be mated therewith in a stair railing system, which comprises the steps of:

a. inserting a corresponding length of flat stock between the flanges of a length of unbent channel stock, the width of said flat stock being generally equal to the distance between said flanges;

b. placing a corresponding length of unbent cap stock together with the length of channel stock fitted with flat stock so that the central longitudinal axis of one length of stock overlies the central longitudinal axis of the second length;

c. placing the length of stock so disposed between the faces of appropriately grooved, fixed backblock and forming die; and d. moving an appropriately grooved drawing block around the grooved face of the forming die, with the lengths of stock held therebetween.

* * * * *

UNITED STATES PATENT AND TRADEMARK OFFICE

CERTIFICATE OF CORRECTION

PATENT NO. : 4,055,065

DATED : October 25, 1977

INVENTOR(S) : Cecil Whetstone, Jr.; Anthony G. Burns

It is certified that error appears in the above-identified patent and that said Letters Patent are hereby corrected as shown below:

Column 1, Line 18, between the words "and" and "plurality" insert --a--.

Column 1, Line 28, "experience" should be --experienced--.

Column 2, Line 28, after "before" insert --bending--.

Column 3, Line 57, after "opposed" insert --side--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*